US005996677A

United States Patent [19]

Woodhouse

[11] Patent Number: 5,996,677

[45] Date of Patent: Dec. 7, 1999

[54] METHOD AND APPARATUS FOR SUPPLYING MOLTEN METAL

[75] Inventor: Gordon Woodhouse, St. Catharines, Canada

[73] Assignees: Connell Limited Partnership; Amcam Castings Limited

[21] Appl. No.: 08/597,952

[22] Filed: Feb. 7, 1996

[51] Int. Cl.[6] ..... B22D 35/00

[52] U.S. Cl. ..... 164/136; 164/133; 164/113; 164/335; 164/336; 164/337; 266/276

[58] Field of Search ..... 164/136, 133, 164/113, 335, 336, 337; 266/165, 276

[56] References Cited

U.S. PATENT DOCUMENTS

| | | | |
|---|---|---|---|
| 3,685,573 | 8/1972 | Domres et al. . | |
| 3,856,183 | 12/1974 | Bauer | 164/336 |
| 4,090,552 | 5/1978 | Laird et al. . | |
| 4,230,308 | 10/1980 | Gueguen . | |
| 4,776,502 | 10/1988 | Hagenburger et al. . | |
| 4,789,020 | 12/1988 | Motomura . | |
| 4,967,827 | 11/1990 | Campbell | 164/133 |
| 5,056,584 | 10/1991 | Seaton . | |
| 5,058,654 | 10/1991 | Simmons et al. . | |
| 5,162,093 | 11/1992 | Fournier et al. . | |
| 5,191,929 | 3/1993 | Kubota et al. . | |

FOREIGN PATENT DOCUMENTS

| | | | |
|---|---|---|---|
| 1-262062 | 10/1989 | Japan | 164/133 |

OTHER PUBLICATIONS

Declaration of Leslie A. Reddick Videotape, Allied Metal Presents: Its Mobile Furnace, Aug. 1989.

*Primary Examiner*—Patrick Ryan
*Assistant Examiner*—I.-H. Lin
*Attorney, Agent, or Firm*—Duane Morris & Heckscher LLP

[57] ABSTRACT

A method and apparatus for supplying molten metal to a die-casting machine. Metal is received from a smelter in a road-going vessel. A burner is lowered into an opening in the road-going vessel to direct heat into the road-going vessel to maintain the molten metal within the road-going vessel at a suitable temperature. Molten metal is transferred from the road-going vessel to a die-casting machine without substantial re-refining. Preferably the molten metal is transferred directly to a die-casting machine using a covered launder system connectable to the road-going vessel to shield the molten metal from atmospheric contact.

17 Claims, 7 Drawing Sheets

METHOD AND APPARATUS FOR SUPPLYING MOLTEN METAL

FIELD OF THE INVENTION

This invention relates to metal die-casting machinery and more specifically to the supply of molten metal to metal die-casting machinery.

BACKGROUND

Metal die-casting is a process in which molten metal, such as aluminum or magnesium is injected into a metal mold to produce a molded article. The molten metal is usually introduced into a shot sleeve which uses a piston or plunger to force the molten metal at pressure into the mold.

The properties of the molded article depend to a large extent on the quality of the molten metal introduced into the mold. Molten metal quality is adversely affected by contaminants such as dissolved hydrogen and oxide impurities. Impurities may be introduced in the molten metal in the smelting process and by exposure to atmosphere.

According to the traditional process, which is still used by many die-casting facilities, metal is initially refined by a metal smelter and cast into ingots. A die caster purchases ingots from the smelter and melts the ingots in a furnace, usually adding scrap metal from the die-casting process. As some refining is carried out in the remelting, ingot metal quality is often not as high as it should be for high quality die cast articles. Some loss of metal occurs through oxide formation on the ingot surface and hydrogen dissolution may occur in the melting process.

A significant amount of energy is wasted in re-melting an ingot as metal which has already been melted to form the ingot has to be re-melted. Typically using a conventional reverbatory furnace, this requires an energy input on the order of 2,500 BTU per pound in the case of aluminum.

Another problem associated with having a die-casting facility melt and at least partially refine its own metal arises when an increase in capacity is required. To add more die-casting equipment it is necessary to increase the ability to melt metal. This requires both capital and space to increase furnace size or the number of furnaces.

One method that has been previously used to enhance furnace capacity is to obtain molten metal from a metal smelter and pour the molten metal directly into the furnace. Molten aluminum is transportable for considerable distances (up to approximately 200 miles) using road-going vessels. Road-going vessels are in essence covered, insulated containers which may be carried on a suitably modified flat-bed trailer.

Having molten metal delivered assists in reducing the amount of furnace capacity and energy required. As molten metal is poured into the furnace, impurities are introduced through contact with the atmosphere therefore requiring at least some further refining before use. Although molten metal delivery maximizes furnace capacity, increasing production would still eventually require increasing the size or number of furnaces.

SUMMARY OF THE INVENTION

A method for supplying molten metal to a die-casting machine comprising the steps of:

i) receiving molten metal in a road-going vessel from a metal smelter;

ii) supplying heat to said molten metal in said road-going vessel to maintain said molten metal at a suitable temperature;

iii) transferring said molten metal from said road-going vessel to said die-casting machinery.

An apparatus for supplying molten metal to a die-casting machine, said apparatus comprising:

a road-going vessel for transporting said molten metal from a smelter to a die-casting facility;

a burner suspended over an opening in said road-going vessel for supplying heat to the interior of said road-going vessel to maintain a suitable metal temperature within said road-going vessel;

a discharge outlet in said road-going vessel through which molten metal may flow under gravitational force;

a launder system;

a valve having an inlet fluidly communicating with said discharge opening and an outlet connectable to a launder system to fluidly communicate therewith, said valve being adjustable to control the rate of metal flow through said discharge opening;

said launder system fluidly connecting said outlet of said valve and said die-casting machine and being sealed to shield molten metal in said launder system from atmospheric contaminants including air which would deleteriously affect metal quality in die-castings produced from said molten metal by said die-casting machine.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 13 is a scanning electron micrograph picture of a piece machined off of the component illustrated in FIGS. 11 and 12.

DESCRIPTION OF PREFERRED EMBODIMENTS

Although the present invention was developed in relation to aluminum die-casting, it is expected that it can be adapted to other metals such as magnesium with suitable safeguards to protect the metal from contact with air.

Figure 1:
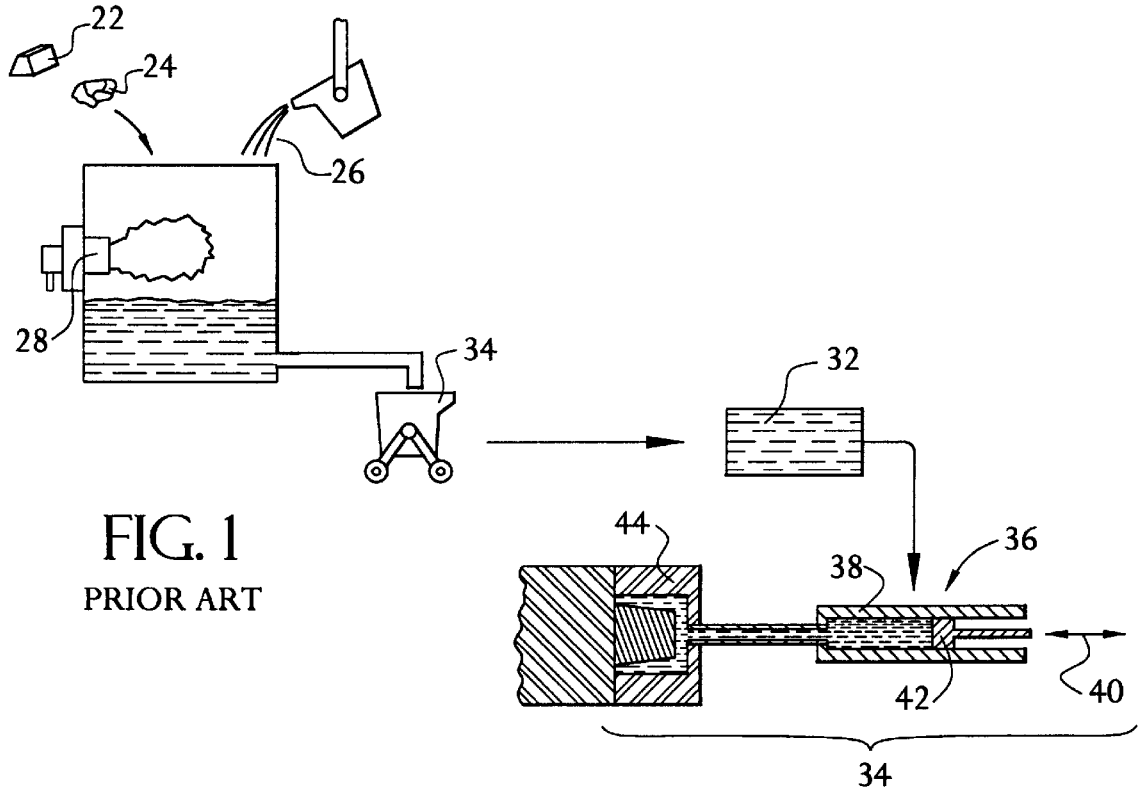
FIG. 1 PRIOR ART
FIG. 1 is a diagrammatic representation of a prior art metal supply system.

FIG. 1 schematically illustrates a prior art die-casting process. A reverbatory furnace 20 ("reverb furnace") is charged with a combination of metal ingots 22, metal scrap 24 and molten metal 26. A burner 28 provides heat to liquify the metal charge and form molten metal 30. The metal is heated for a period of time sufficient to attain suitable temperature for use in die-casting, to enable impurities to separate and to allow trapped gasses to escape.

Molten metal 30 is transferred from the reverb furnace to a molten metal launder 32. A bull ladle 34 may be used to effect the transfer. Molten metal 30 is fed from the metal launder 32 into a die-casting machine generally indicated by reference 34. The die-casting machine has a shot sleeve 36 comprising a cylindrical bore 38 along which is movable, in the direction of arrows 40, a piston or plunger 42. A mold 44 fluidly communicates with the shot sleeve 36 so that molten metal 30 can be forced into the mold 44 by the action of the piston 42 in the bore 38.

The amount of energy typically required in a process melting aluminum ingots and aluminum scrap to produce molten aluminum for die-casting equipment is on the order of 2,500 BTU per pound of aluminum. Although metal recovery is quite good, some losses occur because of impurities in the ingots and oxidation on the surface of the ingots, scrap and molten metal being charged into the reverb furnace 20. The oxides and impurities are skimmed resulting in metal losses on the order of 3%.

Melting metal in a reverb furnace 20 results in hydrogen gas dissolving in the metal. Dissolved hydrogen will result in finished castings (in the case of aluminum) which have poor elongation properties typically on the order of 1.5% to 3.5% for normal die cast 380 alloy. This is not strong enough for use in support frames and impact parts for automotive use. It is expected that if elongation could be increased to 8–10% such parts and as well engine cradles and suspension components could also be satisfactorily made using die-casting processes.

Dissolved hydrogen results in porosity in the finished castings. It also results in reduced casting fluidity, inclusions (oxides), reduced mechanical properties and poor cosmetic surface. This results in rejected castings. Large die-castings with intricate designs, such as transmission cases and covers, can often produce scrap rates as high as 10–12% because of porosity.

As well as avoiding dissolved hydrogen in the molten metal, it is also desirable to minimize exposure of the molten aluminum to air to avoid oxidation and possibly other gas reactions. Oxidation may result in oxide inclusions in die cast parts made from the molten aluminum which diminishes the strength of the parts and limits the scope of die cast applications.

Figure 2:
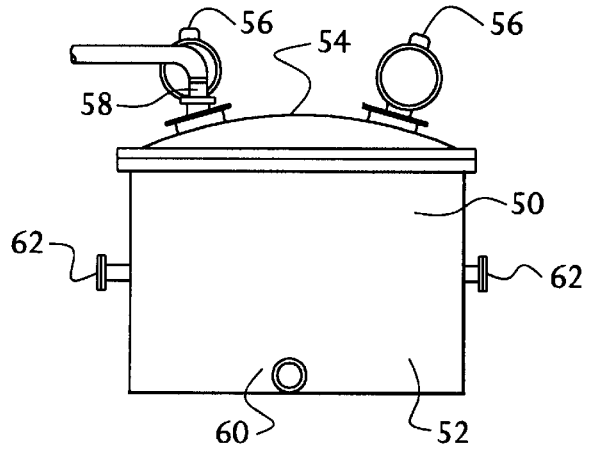
FIG. 2 is an elevation of a road-going vessel.
Figure 3:
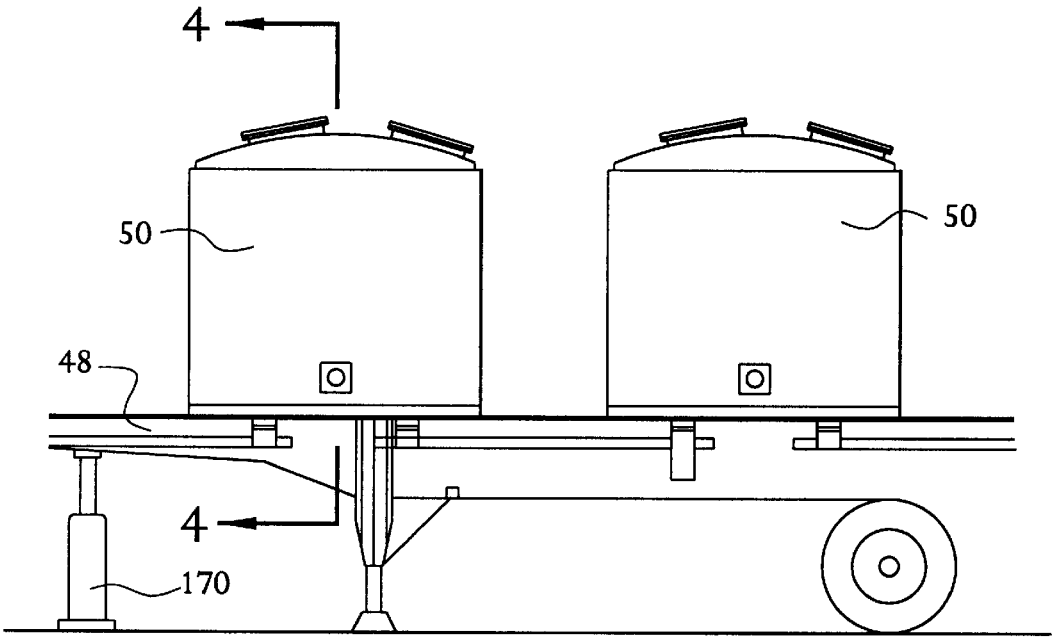
FIG. 3 is an elevation of two road-going vessels on a trailer.

As mentioned in the background above, part or all of the charge into the reverb furnace 20 may be molten aluminum 26 as delivered from a metal smelter. FIG. 2 illustrates a typical road-going vessel 50 which may be used for metal delivery on a trailer 48 as illustrated in FIG. 3.

The road-going vessel 50 has a generally cylindrical lower part 52 and a domed cover 54. Sealable access ports or openings 56 are provided through the cover 54 to enable pre-heating and filling of the road-going vessel 50. In FIG. 2, both openings 56 are shown uncovered. A burner 58 would be used to direct a flame into the road-going vessel 50 through the left hand opening 56. Exhaust gasses may escape through the other right hand opening 56.

A discharge opening or outlet 60 is provided toward the bottom of the road-going vessel 50 through which molten metal can flow under gravitational force. Lifting lugs 62 are provided to assist in moving the road-going vessel 50.

Figure 4:
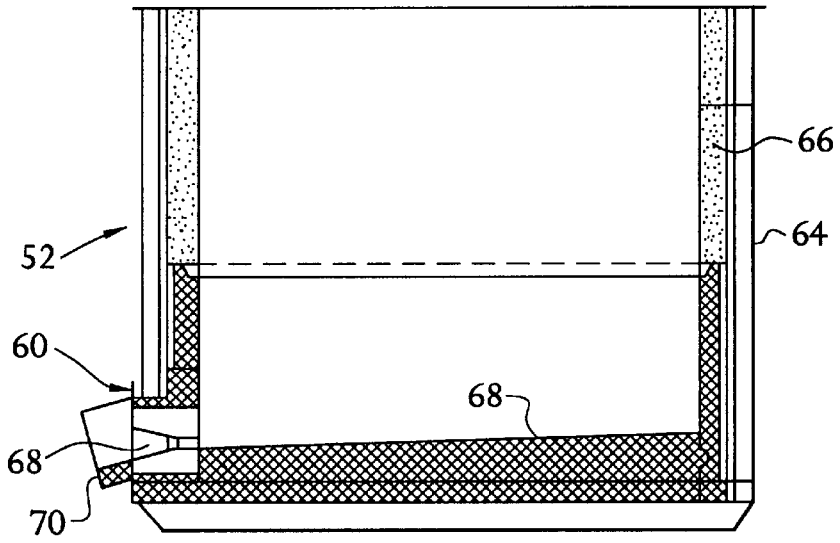
FIG. 4 is a cross-sectional view of the lower part of a road-going vessel taken on line 4—4 of FIG. 3.

FIG. 4 is a cross-section through the lower part 52 of a road-going vessel 50. The lower part 52 has a steel outer shell 64 with a lining 66 made of a refractory material. The refractory lining 66 has a sloped floor 68 which slopes toward the discharge opening 60 to assist in emptying the road-going vessel 50. The discharge opening 60 has a conical orifice 68 and a spout 70.

Figure 5:
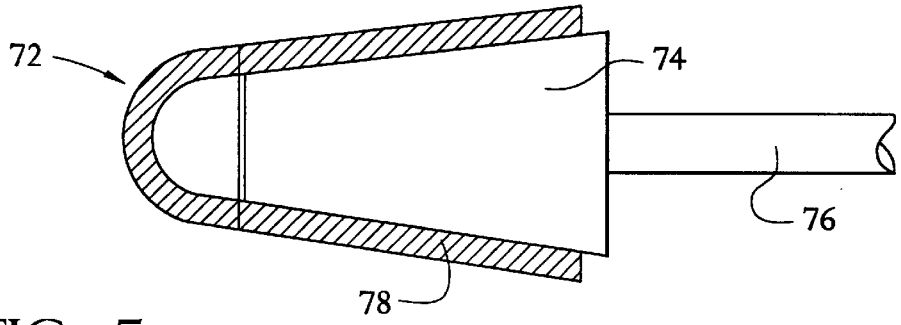
FIG. 5 is a cross-section through a tap-out cone.

FIG. 5 illustrates a conical seal 72 used for sealing the conical orifice 68. The conical seal has a conical metal plunger 74 mounted to the end of a rod 76. A refractory ceramic fiber core 78 is mounted over the plunger 74 and may be forced with plunger 74 into the conical orifice 68 to seal the orifice 68. The plunger 74 is then removed. Opening of the orifice 68 may be achieved by using a rod to pierce the ceramic fiber cone 78.

It has been determined that the quality of metal received from a smelter in a road-going vessel is quite high in terms of the amount of dissolved hydrogen and other impurities. A typical ingot would have 20 to 30 cc/100 g hydrogen and metal die casters that melt ingots to produce molten metal often use degassing equipment to reduce the dissolved hydrogen to around 0.09 cc/100 g. Metal "as delivered" in a road-going vessel may however have dissolved hydrogen levels of around 0.06 cc/100 g or less! Accordingly, transferring molten metal to a die-casting machine as close to its "as delivered" purity as possible not only reduces energy requirements but will also produce die-castings of a very high quality.

According to the present invention, the road-going vessel is modified, as described in more detail below, to enable molten metal to be transferred directly from the road-going vessel to a die-casting machine without transfer to a reverb furnace for further smelting. Initially, there was concern that problems would arise from non-uniform preheating of the road-going vessel 50 and temperature stratification on filling of the vessel. Surprisingly however, the time and motion in transport resulted in molten metal being delivered at a uniform temperature at the die-casting facility.

Figure 7:
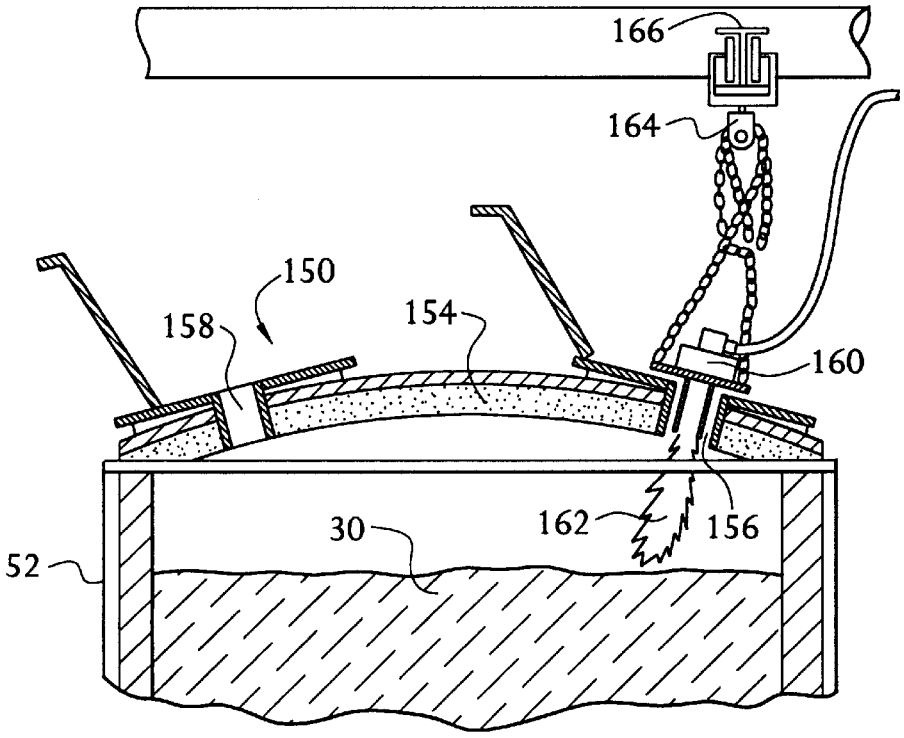
FIG. 7 is a partial cross-sectional view through a road-going vessel illustrating the mounting of a burner over a road-going vessel.
Figure 8:
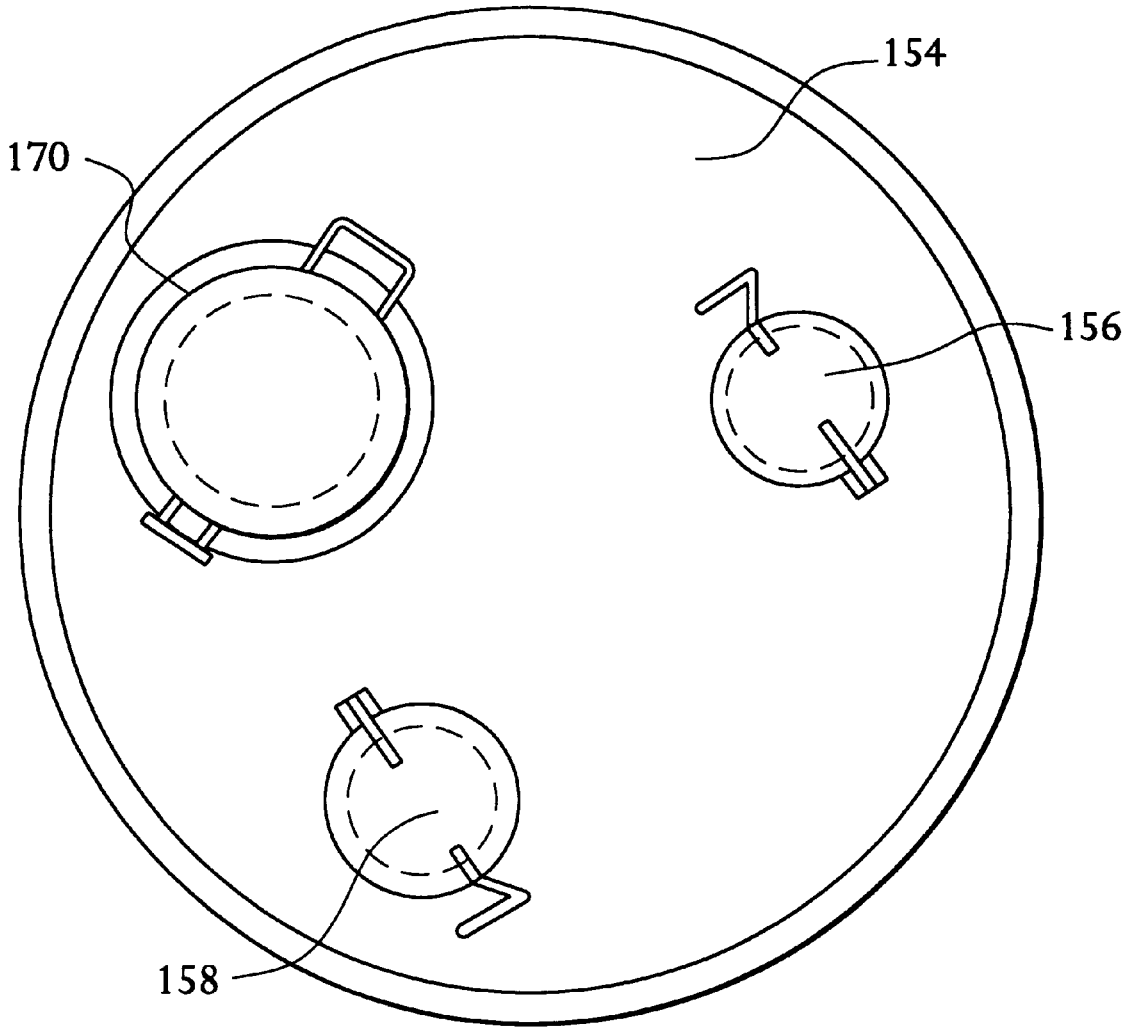
FIG. 8 is a plan view of a modified cover.

The modifications to the road-going vessel include provision for the application of heat to maintain the molten metal 30 at a suitable temperature for the die-casting machine. FIG. 7 illustrates a modified cover 154 over a conventional lower part 52 of a modified road-going vessel 150. FIG. 8 is a plan view of a modified cover 154.

The modified cover 154 has a burner port 156 and an exhaust port 158 extending through it. The burner port 156 is an opening over which a burner 160 may be suspended to direct heat in the form of a flame 162 into the modified road-going vessel 150. The burner 160 is shown as being suspended by a hoist 164 connected to an overhead rail 166. Reference 170 indicates an opening through the modified cover 154 for filling the modified road-going vessel 150.

The burner 160, the burner port 156 and the exhaust port 158 should be sized and operated so as to minimize the amount of air introduced into the modified road-going vessel 150 and the amount that the molten metal 30 is disturbed. Satisfactory results have been obtained for a 10 ton molten aluminum carrying road-going vessel using a 500,000 BTU pre-mix burner and six inch (approximately 15 cm) diameter burner and exhaust ports. Minimizing air entrainment is important to avoid oxide formation which is not only undesirable in the metal but also affects the use of an infra-red burner control system.

The modified road-going vessel 150 may be used in much the same manner as discussed above in relation to a reverb furnace. Molten metal may be tapped from the modified road-going vessel 150 into a bull ladle and transferred to a molten metal launder such as illustrated respectively as references 34 and 32 in FIG. 1. To further minimize exposure to air, a covered transfer ladle, such as a barrel ladle, may be used. With suitable safety precautions, the modified road-going vessel 150 may be left on a trailer such as illustrated by reference 48 in FIG. 3. Safety precautions include supporting the front of the trailer 48 with a jack 170 and providing adequate ventilation for exhaust gasses emanating from the exhaust port 158.

It has been found that the amount of energy required (based on gas consumption) to maintain molten metal 30 at a suitable temperature in a modified road-going vessel 150 is approximately 80 BTU per pound which is significantly less than the 2,500 BTU per pound required to melt ingots in a reverb furnace 50 or the 500 to 700 BTU per pound required to maintain molten metal temperature in a reverb furnace 50.

Figure 6:
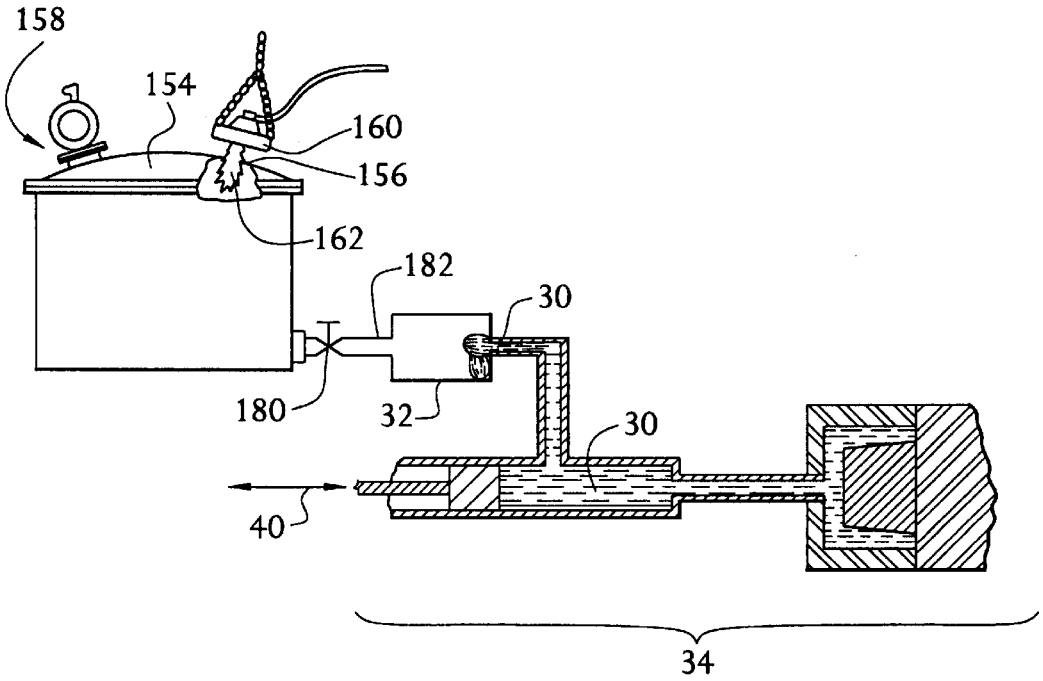
FIG. 6 is a diagrammatic representation of a method according to the present invention.

To further ensure the highest quality die-castings, it is preferable to avoid having the molten metal 30 contact the atmosphere during transfer from the modified road-going vessel 150 to the die-casting machine 34. FIG. 6 also illustrates a method according to which this may be achieved. The modified road-going vessel 150 is provided with a valve 180 at its outlet rather than a spout (such as indicated by reference 70 in FIG. 4). The valve is connected via an enclosed fluid conduit 182 to the molten metal launder 32. Nitrogen gas may be fed into the enclosed fluid conduit 182 to displace any air. Preferably the valve is adjustable to control the flow of molten metal 30 to maintain a relatively constant depth of molten metal 30 in the molten metal launder 32.

In order to transfer the molten metal 30 directly into a launder system without the use of a transfer ladle, it is necessary to have an adjustable valve which can control the rate of metal flow.

Figure 9:
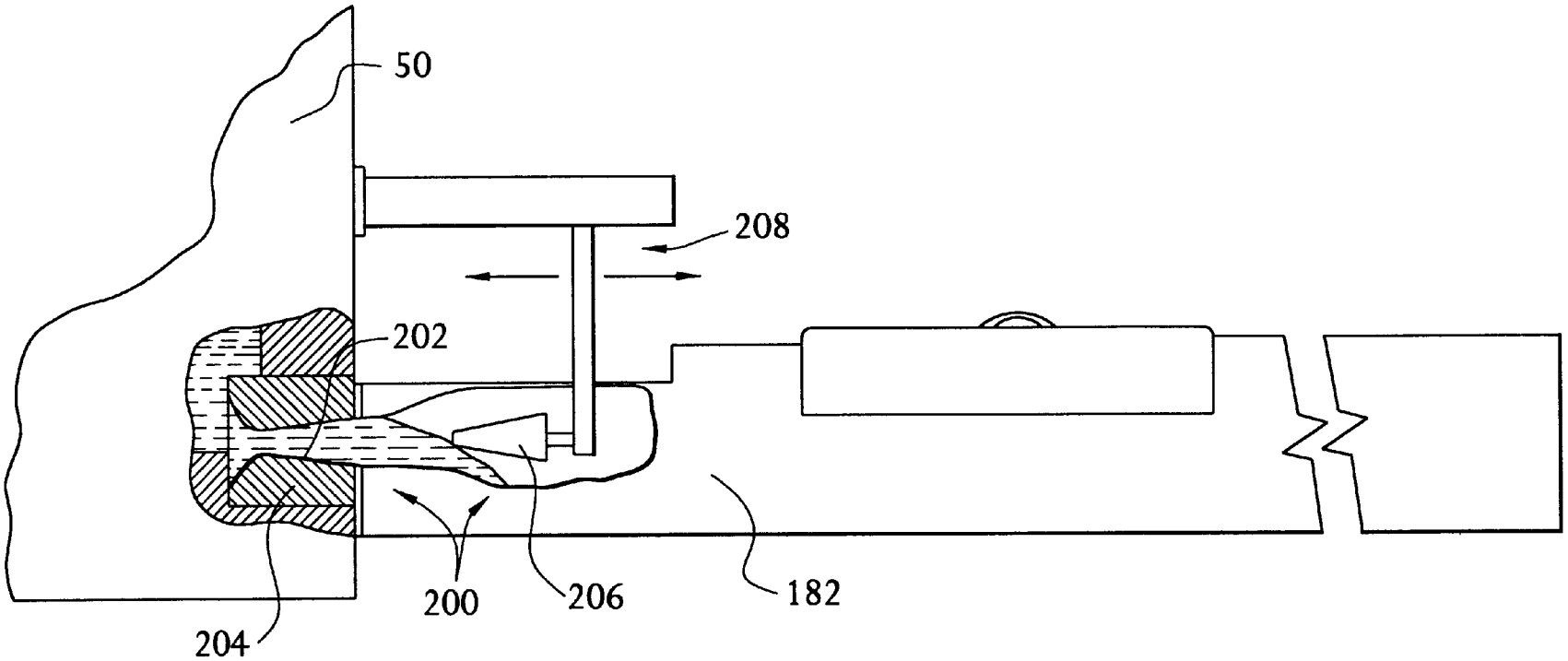
FIG. 9 is a partially cut-away view showing an adjustable valve.

A significant factor in valve design is the avoidance of erosion by molten aluminum. Although either plug valves or ball valves could conceivably be used, the best results to date have been obtained in using plug valves with ceramic tips of the type illustrated in FIG. 9 and generally indicated by reference 200.

The plug valve 200 has a conical seat 202 formed in a refractory block 204 which forms an outlet or discharge opening for the road-going vessel 50. A conical or frustroconical plug 206 is aligned with and registers with the conical seat 202. A control mechanism 208 is used to control the relative juxtaposition of the plug 206 and the seat 202.

The materials used for the plug 206 and the seat 202 should exhibit corrosion resistance, erosion or abrasion resistance, oxidation resistance, basic strength and impact resistance, life expectancy and should be of reasonable cost. One material which has produced reasonable results is a coating material comprising approximately 30% molybdenum, 5% silicon carbide and 65% titanium. The coating material is bonded to a metal plug. As this material contains a relatively high percentage of molybdenum, it is prone to oxidation during preheat of the road-going vessel 50 during preheat prior to filling at the smelter. To avoid this, a ceramic fiber cone, similar to that described above and illustrated as reference 78 in FIG. 5, should be placed over the plug 206 during the preheat operation.

An alternative material having significantly better oxidation resistance is a compound containing 5% cobalt, 7% silicon carbide and 88% titanium. This compound has about eight (8) times the oxidation resistance to the molybdenum containing compound described above, attributable to a large extent to its cobalt content. Nevertheless, use of a protective ceramic cone during preheat would still be recommended. Silicon nitride may be another suitable material.

The invention is further illustrated with reference to the following examples:

EXAMPLE 1

A series of tests were conducted to determine the hydrogen gas content in the molten aluminum at an aluminum die-casting facility. The hydrogen analyzer for molten aluminum alloys that was used was the NOTORP KYHS-A1. The NOTORP unit has a probe that is submersed in the molten aluminum. This probe measures two things, the temperature of the molten aluminum in degrees Celsius and the concentration of hydrogen gas. The concentration of hydrogen gas is measured in cc's or ml/100 g of aluminum.

Hydrogen gas in molten aluminum alloys causes several types of defects in the cast products. Defects include reduced casting fluidity, porosity defects, inclusions (oxides), reduced mechanical properties and a poor cosmetic surface. For this reason the hydrogen level must be kept to a minimum. The purpose of this study was to determine whether the repeatability of the hydrogen gas content in the molten aluminum produced by a smelter and consumed at the die-caster is at an acceptable level.

The main focus of this study was the molten aluminum shipments that are received daily from the smelter. The hydrogen content was tested as the ladles were being filled by the foundry department. An average of four to five ladles were tested from each pot and a total of five different pots were tested.

The secondary scope of this study was to test the efficiency of the degassing process. To accomplish this, the hydrogen gas content of the molten aluminum was tested as it came out of the reverb furnace and again after the degassing process to determine the effects and the efficiency of the degassing process.

Finally, tests were conducted on four of the holders to determine the hydrogen content just before casting. To do this, the probe was inserted into the dip well of the holders.

After testing a total of 22 ladles of molten aluminum at the pots, it was found that the average hydrogen content was 0.044 ml/100 g-Al.

The average hydrogen content of molten aluminum at the reverbs was 0.092 ml/100 g-Al. After the aluminum was degassed, the average hydrogen content was 0.071 ml/100 g-Al. This shows an average drop of 0.021 ml/100 g-Al.

The average hydrogen content of molten aluminum in the holders was found to be 0.052 ml/100 g-Al.

Summary of Hydrogen Gas Content

| Test Location | Average Hydrogen Content | Average Temperature Cel. | Average Temperature Per. |
|---|---|---|---|
| Pots | 0.044 | 656 | 1213 |
| Reverb | 0.092 | 696 | 1285 |
| Degasser | 0.071 | 690 | 1274 |
| DCM | 0.052 | 662 | 1224 |
| Averages | 0.065 | 676 | 1249 |

There is no set industry standard for the concentration of hydrogen gas in molten aluminum. The lower the gas content though the less chance of casting defects. With this in mind it can be said that any hydrogen gas concentration over 0.100 ml/100 g-Al is unacceptable. It is said that 0.070 ml/100 g-Al would be an optimum content of gas in the aluminum.

It can be seen that the hydrogen gas content in the molten aluminum shipped to the die-caster by the smelter is well within acceptable limits and shows that the smelter is capable of supplying quality molten aluminum in repeated shipment to the die-caster.

The average concentration of hydrogen gas of 0.044 ml/100 g-Al found in the molten aluminum shipments is conducive to producing good castings.

It was also found that the average hydrogen gas content in the molten aluminum from the reverbatory furnaces is (0.092 ml/100 g-Al) but after the degassing process the content drops to an acceptable level of 0.071 ml/100 g-Al. This value is at an acceptable level. If the molten Aluminum was subjected to degassing for a longer period of time, the concentration of hydrogen would be brought to even lower levels.

The average hydrogen gas content in the dip wells of the holders is at an acceptable level of 0.052 ml/100 g-Al. This value is approximately an average of the concentration of hydrogen in the aluminum from the reverbs through degassing and/or the molten metal pots. If the hydrogen concentration in the aluminum from the reverbs was lowered by a longer degassing cycle, the concentration at the holders would in turn be lower and in turn produce better parts.

Figure 10:
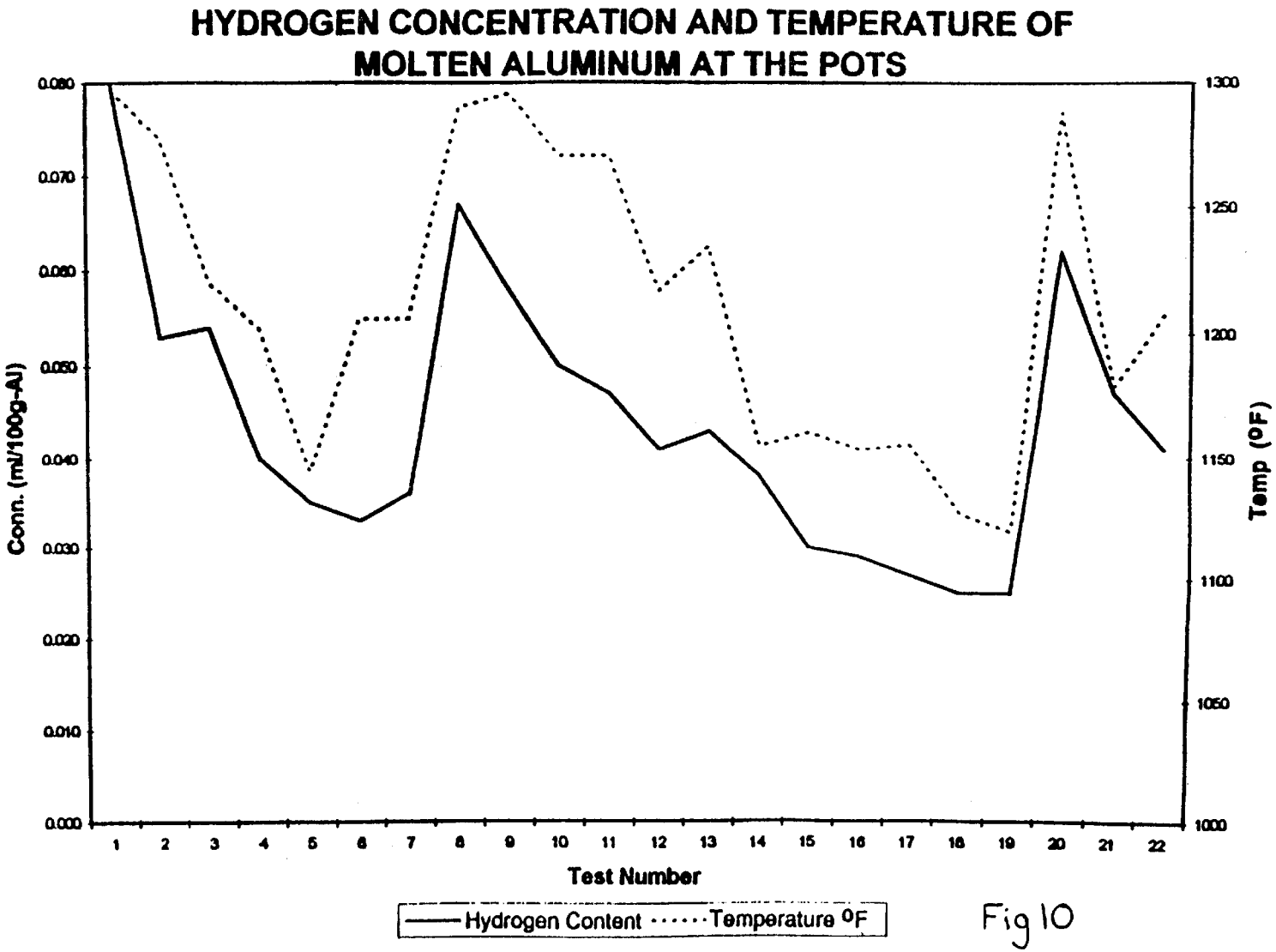
FIG. 10 is a graph illustrating the relationship between hydrogen concentration and temperature of molten aluminum.

The results are summarized in the following tables and in the graph which comprises FIG. 10.

Hydrogen Gas Content in Molten Aluminum
Test Location: Smelter Pots

| Test Number | Pot Number | Time | Hydrogen Content | Temperature Cel. | Temperature Fer. |
|---|---|---|---|---|---|
| 1 | 27 | 10:15 | 0.080 | 703 | 1297 |
| 2 | 27 | 12:15 | 0.053 | 692 | 1278 |
| 3 | 27 | 12:18 | 0.054 | 660 | 1220 |
| 4 | 27 | 12:34 | 0.040 | 650 | 1202 |
| 5 | 20 | 16:20 | 0.035 | 618 | 1144 |
| 6 | 20 | 16:30 | 0.033 | 652 | 1206 |
| 7 | 20 | 17:10 | 0.036 | 652 | 1206 |
| 8 | 27 | 9:34 | 0.067 | 699 | 1290 |
| 9 | 27 | 9:43 | 0.058 | 702 | 1296 |
| 10 | 27 | 10:24 | 0.050 | 688 | 1270 |
| 11 | 27 | 10:40 | 0.047 | 688 | 1270 |
| 12 | 27 | 11:10 | 0.041 | 658 | 1216 |
| 13 | 27 | 11:24 | 0.043 | 668 | 1234 |
| 14 | 20 | 14:38 | 0.038 | 624 | 1155 |
| 15 | 20 | 14:46 | 0.030 | 627 | 1161 |
| 16 | 20 | 15:24 | 0.029 | 623 | 1153 |
| 17 | 20 | 15:32 | 0.027 | 624 | 1155 |
| 18 | 20 | 16:28 | 0.025 | 608 | 1126 |
| 19 | 20 | 16:34 | 0.025 | 604 | 1119 |
| 20 | 24 | 21:39 | 0.062 | 698 | 1288 |
| 21 | 24 | 22:10 | 0.047 | 637 | 1179 |
| 22 | 24 | 22:19 | 0.041 | 653 | 1207 |
| Averages | | | 0.044 | 656 | 1212 |
| Median | (Middle Value) | | 0.041 | 653 | 1207 |
| Mode | (Most often occuring) | | 0.047 | 652 | 1206 |

Hydrogen Gas Content in Molten Aluminum
Test Location: Reverbs

| Reverb Number | Time | Hydrogen Content | Temperature Cel. | Temperature Fer. |
|---|---|---|---|---|
| 5 | 13:12 | 0.120 | 720 | 1328 |
| 5 | 13:30 | 0.089 | 718 | 1324 |
| 5 | 21:30 | 0.075 | 672 | 1242 |
| 5 | 9:10 | 0.067 | 657 | 1215 |
| 5 | 9:15 | 0.055 | 638 | 1180 |
| 7 | 11:20 | 0.145 | 773 | 1423 |
| Averages | | 0.092 | 696 | 1285 |

Hydrogen Content in Molten Aluminum
Test Location: Degasser

| Time | Hydrogen Content | Temperature Cel. | Temperature Fer. | Comments |
|---|---|---|---|---|
| 13:20 | 0.071 | 697 | 1287 | from Rev #7 |
| 15:17 | 0.072 | 698 | 1288 | from Rev #5 |
| 15:31 | 0.102 | 734 | 1353 | from Rev #5 |
| 21:08 | 0.066 | 665 | 1229 | from Rev #5 |
| 21:13 | 0.058 | 676 | 1249 | from Rev #5 |
| 21:19 | 0.079 | 707 | 1305 | from Rev #5 |
| 9:25 | 0.051 | 655 | 1211 | from Rev #5 |
| Averages | 0.071 | 690 | 1275 | |

Hydrogen Content in Molten Aluminum
Test Location: DCM

| DCM Number | Time | Hydrogen Content | Temperature Cel. | Temperature Fer. |
|---|---|---|---|---|
| 5 | 13:35 | 0.043 | 639 | 1182 |
| 1 | 22:24 | 0.055 | 686 | 1267 |
| 10 | 11:00 | 0.055 | 653 | 1207 |
| 11 | 11:02 | 0.055 | 669 | 1236 |
| Averages | | 0.052 | 662 | 1223 |

EXAMPLE 2

A tap-out block and TM6 METAC seat combination were installed in preparation for metal testing. When attempting to test fit the valve tip, it was evident that mortar used on the block installation had flowed into the seat area during the vessel's preheat. It was necessary to chip off the mortar and then buff the seat clean before the tip could be installed. When the TM6 tip was installed into the seat for a test fit, it became lodged tightly in the seat due to expansion. The seat had been preheated and the tip was a room temperature. The tip was removed from the seat without damage. To prevent the same effect again, it was necessary to continue the preheat with the valve in the open position to allow the tip to get to the temperature of the seat.

At 2 pm, approximately 5,000 lbs of aluminum (1375° F., slightly cool) was tapped into the vessel with the valve closed. The vessel was brought into an area where "sows" are poured. The vessel was put into position and the valve opened easily. The valve was opened and closed approximately 10 times without a problem (no leakage).

The flow of aluminum when the valve was opened was studied. It was apparent that the molten aluminum flowed through the seat area and then down the surface of the H13 rod in a smooth pattern. The metal did not splash or spray in the cone area of the valve. It was only upon hitting the handle connection at the back of the H13 rod that the flow became deformed.

After the aluminum was completely drained, the vessel was returned to the furnace and filled completely (approximately 15,000 lbs). The vessel was again brought to the sow area and tapped. With the increase in the height of the aluminum, the pressure was greater and the flow dispersion was more pronounced at the end of the H13 rod. The same phenomena as noted previously was noticed. The molten aluminum hugged the H13 rod until it struck the handle connection. The valve again worked flawlessly in stopping and starting the flow of aluminum approximately 12 times.

After completion of this tap, it was decided to dismantle the valve for examination of the components. The valve was dismantled and the plunger/tip was allowed to cool. It was immediately evident that the tip area of the plunger was wetted and coated with aluminum. The H13 rod was easily cleaned of aluminum, but the tip was not. It was decided to further examine the tip and report on the reaction of the TM6 to the molten aluminum flow.

Valve Operation Observations and Recommendations:

(A) The sticking of the tip inside the seat was caused by the temperature differential between the two components. This was caused when the seat was preheated in advance of the tip insertion. This can be eliminated by preheating the vessel with the tip and seat installed, allowing them to remain at the same temperature. It may also be alleviated by increasing the tip/seat angle.

(B) The flow of the molten aluminum was diverted by the handle connection at the back of the H13 connecting rod. It was apparent that the flow of aluminum could be accurately directed with an impeller/fin arrangement on the surface of the H13 plunger rod.

TM6 METAC—Tip Post Trial Examination

The tip was returned to Burlington and cleaned of the adhered aluminum. It was evident after cleaning that the surface of the tip had been adversely affected by the testing done. The surface of the tip had been evenly washed away to a depth of approximately 0.5 mm over an area of approximately 80% of its surface area.

Figure 11:
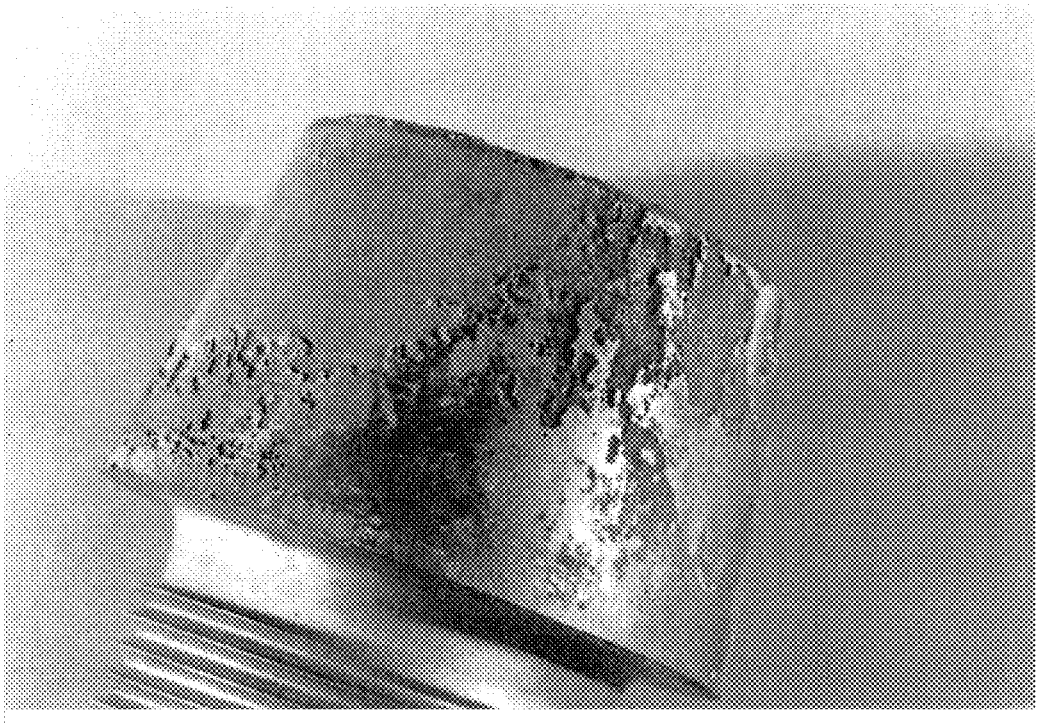
FIG. 11 shows a component of a variable valve according to the present invention after use.
Figure 12:
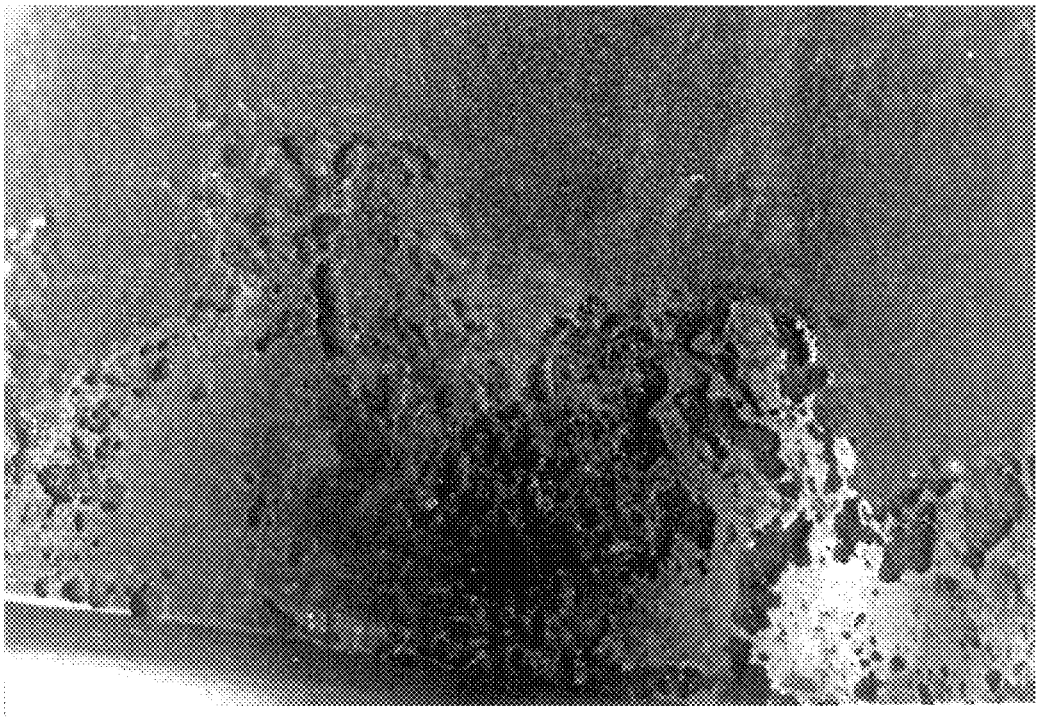
FIG. 12 is an increased magnification view corresponding to FIG. 11.

FIG. 11 is a macro photograph of TM6 Metac tip after use. Shiny areas show machine marks. This is the original surface of the valve tip. The rough surface is the area of removed material due to oxidation. FIG. 12 shows an increased magnification of a used TM6 tip showing areas of missing material due to oxidation and the original machine surface.

TM6 METAC Tip—SEM and EPMA Examination

The tip was sectioned and the resulting piece was closely studied. The TM6 material (30% Mo—5% SiC—65% Ti) contains a high percentage of Mo, which is prone to oxidation. The preheat of the molten aluminum vessel with the valve open, allowed the surface of the material to be exposed to the oxidizing flame of the burner. This oxidized the Mo which affected the Si and Ti distribution near the tip's surface. The washing action of the aluminum metal removed the thin affected layer.

Recommendations (A) The valve tip and seat should be protected from the oxidizing atmosphere by preheating the vessel with the valve in the closed position. A fiber gasket could be utilized on the surface of the tip to seal the joint between the tip and seat during preheat.

(B) TM6 is prone to oxidation in this valve arrangement due to its high Mo content. Oxidation is not a problem for TM6 in a die-casting sleeve as the arrangement is not as severe in atmosphere or temperature.

(C) TS7 METAC (5% Co—7% SiC—88% Ti) is recommended for this application. In oxidation tests, TS7 METAC is 8 times more oxidation resistant then TM6 METAC due to its Co content.

| | |
|---|---|
| Oxidation Test: | Temperature: 1000° C.<br>Duration: 2 Hours<br>Atmosphere: Air<br>Measurement Increase in Weight |
| Results: | TM6 MBTAC: +25%<br>TS7 METAC: +3% |

The above description and examples should be interpreted in an illustrative rather than a restrictive sense. Variations may be apparent to appropriately skilled persons while remaining within the spirit and scope of the invention as defined in the claims which are set out below.

I claim:

1. A method for supplying molten metal to a die-casting machine comprising the steps of:

I) receiving molten metal in a road-going vessel from a metal smelter;

II) supplying heat with a burner to said molten metal in said road-going vessel to maintain said molten metal at a suitable temperature while avoiding excessive heating of said metal and limiting air entrainment into said vessel to minimize oxidation and gassing of said molten metal; and, III) transferring said molten metal from said road-going vessel to said die-casting machine.

2. A method as claimed in claim 1 wherein said transferring in step III includes the steps of:

i) tapping at least some of said molten metal from said road-going vessel into a covered ladle through a discharge opening located toward a bottom of said road-going vessel and through which substantially all of said molten metal may flow directly under the force of gravity;

ii) transporting said ladle to a die cast holding furnace associated with said die-casting machine; and, iii) transferring said molten metal from said ladle to said holding furnace.

3. A method as claimed in claim 1 wherein said molten metal is transferred in step III directly from said road-going vessel to said die-casting machine via a launder system and during said transfer said molten metal is protected from contact with air.

4. A method as claimed in claim 3 wherein a valve is connected to an outlet in said road-going vessel and said valve is used to control flow of said metal from said road-going vessel into said launder system.

5. A method according to claim 3 wherein said molten metal is magnesium.

6. A method as claimed in claim 1 wherein said molten metal is transferred in step III directly from said road-going vessel to said die-casting machine via a launder system and during said transfer contact is substantially avoided between said molten metal and substances which may adversely affect the quality of metal in castings produced by said die-casting machine.

7. A method as claimed in claim 6 wherein a valve is connected to an outlet in said road-going vessel and said valve is used to control flow of said metal from said road-going vessel into said launder system.

8. A method as claimed in claim 1 wherein said supplying of heat in step II is carried out by suspending a burner over an opening in said road-going vessel and directing flame from said burner into said opening.

9. A method as claimed in claim 8 wherein said road-going vessel is situated on a trailer while said method is carried out.

10. A method according to claim 8 wherein said molten metal is aluminum.

11. A method according to claim 1 wherein said molten metal is aluminum.

12. An apparatus for supplying molten metal to a die-casting machine, said apparatus comprising:

a road-going vessel for transporting said molten metal from a smelter to a die-casting facility;

a burner suspended over an opening in said road-going vessel for supplying heat to the interior of said road-going vessel to maintain a suitable metal temperature within said road-going vessel;

a discharge opening in said road-going vessel through which molten metal may flow under gravitational force;

a launder system;

a valve having an inlet fluidly communicating with said discharge opening and an outlet fluidly communicating with a launder system, said valve being adjustable to regulate the rate of molten metal flow through said discharge opening;

said launder system fluidly connecting said outlet of said valve and said die-casting machine and being sealed to shield molten metal in said launder system from atmospheric contaminants including air which would deleteriously affect metal quality in die-castings produced from said molten metal by said die-casting machine.

13. An apparatus as claimed in claim 12 wherein said road-going vessel is provided with a burner port and an exhaust port;

said opening over which said burner is suspended is said burner port; and said burner and exhaust ports are sized to minimize air entrainment and metal oxidation during use of said burner.

14. An apparatus as claimed in claim 13 wherein said road-going vessel has a cover with at least one sealable opening in said cover to permit said road-going vessel to be pre-heated and filled with molten metal; each said opening being separate from said burner and exhaust ports.

15. A modified road-going vessel for transporting molten metal and enabling heat to be supplied to the molten metal upon delivery, said modified road-going vessel comprising:

a lower part for receiving and holding said molten metal;

an outlet at the bottom of said lower part to permit said molten metal to be drained from said lower part; and, a cover over said lower part, said cover having a burner port, an exhaust port and an opening through which molten metal may be introduced into said road-going vessel, said burner port being dimensioned to register with a burner for supplying sufficient heat to said road-going vessel to maintain said molten metal in its molten state, said burner and exhaust ports further being dimensioned to minimize air entrainment into said road-going vessel during operation of said burner and consequent oxidation of said molten metal.

16. A road-going vessel as claimed in claim 15 wherein said outlet is configured to register with an adjustable valve.

17. A road-going vessel as claimed in claim 15 wherein said molten metal is aluminum, said burner and exhaust ports have a diameter of six inches (6") and said burner has a capacity of 500,000 BTU.

* * * * *